United States Patent [19]

Sakuranaka

[11] Patent Number: 4,557,240

[45] Date of Patent: Dec. 10, 1985

[54] INJECTION TIMING CONTROL DEVICE FOR DISTRIBUTOR-TYPE FUEL INJECTION PUMPS

[75] Inventor: Toru Sakuranaka, Higashimatsuyama, Japan

[73] Assignee: Diesel Kiki Co., Ltd., Tokyo, Japan

[21] Appl. No.: 729,694

[22] Filed: May 2, 1985

[30] Foreign Application Priority Data

May 9, 1984 [JP] Japan ..... 59-92459

[51] Int. Cl.[4] ..... F02M 59/20

[52] U.S. Cl. ..... 123/502; 123/179 L

[58] Field of Search ..... 123/179 L, 502, 500, 123/501; 123/449; 417/462

[56] References Cited

U.S. PATENT DOCUMENTS

| | | | |
|---|---|---|---|
| 4,271,806 | 6/1981 | Kaibara | 123/502 |
| 4,329,961 | 5/1982 | Johnston | 123/502 |
| 4,408,591 | 10/1983 | Nakamura | 123/502 |
| 4,422,428 | 12/1983 | Eheim | 123/502 |
| 4,432,327 | 2/1984 | Salzgeber | 123/502 |

FOREIGN PATENT DOCUMENTS

| | | | |
|---|---|---|---|
| 3201914 | 8/1983 | Fed. Rep. of Germany | 123/502 |
| 55-49078 | 9/1953 | Japan | 123/502 |
| 0157026 | 9/1982 | Japan | 123/502 |
| 59-163644 | 10/1983 | Japan | 123/502 |

*Primary Examiner*—Carl Stuart Miller

*Attorney, Agent, or Firm*—Frishauf, Holtz, Goodman & Woodward

[57] ABSTRACT

In addition to a conventional first communication passageway communicating the suction space of a distributor-type fuel injection pump with a hydraulic oil chamber defined at one end of the timer piston via a servo valve acting to prevent vibration of the roller holder, a second communication passageway is provided for communicating the suction space with the hydraulic oil chamber while the timer piston is displaced at least through a stroke corresponding to a predetermined starting advance in the injection timing. Selector means closes the first communication passageway and simultaneously opens the second communication passageway when a temperature of the engine is below a predetermined value, while it opens the first communication passageway and simultaneously closes the second communication passageway when the temperature of the engine is above the predetermined value, to thereby achieve positive starting of the engine in a cold condition.

7 Claims, 5 Drawing Figures

INJECTION TIMING CONTROL DEVICE FOR DISTRIBUTOR-TYPE FUEL INJECTION PUMPS

BACKGROUND OF THE INVENTION

This invention relates to an injection timing control device for distributor-type fuel injection pumps, and more particularly to improvements in starting injection timing advance means provided in fuel injection pumps of this kind for advancing the injection timing at the start of the engine in a cold condition such as in cold weather.

An injection timing control device provided in distributor-type fuel injection pumps for diesel engines typically comprises a roller holder carrying a plurality of rollers circumferentially arranged and disposed in camming engagement with an end face of a pumping and distributing plunger connected to the output shaft of an engine, a timer piston coupled to the roller holder and arranged to be urged at its one end face by fuel pressure variable as a function of the engine speed supplied from the suction chamber of the pump, and a timer spring arranged to urge the timer piston against the fuel pressure. The timer piston is therefore displaceable in response to a change in the engine speed to cause a corresponding change in the circumferential position of the roller holder, which in turn causes a change in the axial operative position of the plunger relative to the circumferential phase of the engine output shaft to vary the injection timing.

In the conventional injection timing control device, due to rotative contact of a cam disc integral with the plunger with the rollers on the roller holder, a torque reaction force acts upon the rollers so as to cause circumferential vibration of the roller holder, which vibration is transmitted to the timer piston to cause axial vibration thereof. As a consequence, fuel is alternately introduced into and discharged from a hydraulic oil chamber defined at the one end of the timer piston, to amplify the axial vibration of the timer piston, resulting in unstable control of the injection timing during constant-speed or constant-load operation of the engine.

To prevent such phenomenon, an injection timing control device for distributor-type fuel injection pumps has been proposed by U.S. Pat. No. 4,408,591 assigned to the same assignee of the present application, which is provided with a servo valve disposed to separate the hydraulic oil chamber defined at one end of the timer piston from the suction chamber to keep the interior of the chamber under constant pressure to thereby prevent vibration of the timer piston attributable to a torque reaction force acting thereon, during constant-speed or constant-load operation of the engine.

On the other hand, injection timing control devices of the aforementioned type are generally provided with injection timing advance means for obtaining a required injection timing advance at the start of the engine so as to facilitate starting of the engine in a cold condition. Conventionally, such injection timing advance means include a type in which an auxiliary piston is urged by a spring having a setting load larger than a timer spring urging a timer piston, to bias the timer piston in an injection timing-advanced position at the start of the engine in a cold condition, as disclosed in Japanese Provisional Utility Model Publication No. 55-49078, and a type in which a roller holder of the injection timing control device is rotated in the injection timing advancing direction directly by a starting injection timing advance lever driven by an actuator, at the start of the engine in a cold condition, as disclosed in Japanese Provisional Utility Model Publication No. 58-163644.

However, these conventionally proposed injection timing advance means are large in size and complicated in construction, and therefore are not suitable for use in an injection timing control device equipped with a servo valve, referred to hereinbefore.

SUMMARY OF THE INVENTION

It is the object of the invention to provide an injection timing control device for distributor-type fuel injection pumps, which is provided with injection timing advance means which is capable of positively and reliably obtaining an advance in the injection timing at the start of the engine in a cold condition, and which is simple in construction and can be designed compact in size and light in weight.

According to the invention, first and second communication passageways extend between a suction space of a distributor-type fuel injection pump and a first chamber defined at one end face of a timer piston, and are located at least in part within the timer piston. Servo valve means is arranged across the first communication passageway at a location within the timer piston, which has a valve body displaceable relative to the timer piston against the force of a timer spring in response to a change in fuel pressure within the suction space variable as a function of the rotational speed of the engine, to selectively assume a first position where it disconnects a portion of the first communication passageway closer to the first chamber with respect to the valve body from the suction space and simultaneously communicates same with the second chamber, a second position where it communicates the first communication passageway portion with the suction space and simultaneously disconnects same from the second chamber, and a third position where it disconnects the first communication passageway portion from both of the suction space and the second chamber.

Means is provided for keeping the second communication passageway opened while the timer piston is displaced from its initial starting position at least to a position corresponding to a predetermined advance in the injection timing, at the start of the engine.

Selector means is responsive to a temperature of the engine to close the first communication passageway portion and simultaneously open the second communication passageway, when the temperature of the engine is lower than a predetermined value, and to open the first communication passageway portion and simultaneously close the second communication passageway when the temperature of said engine is higher than the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
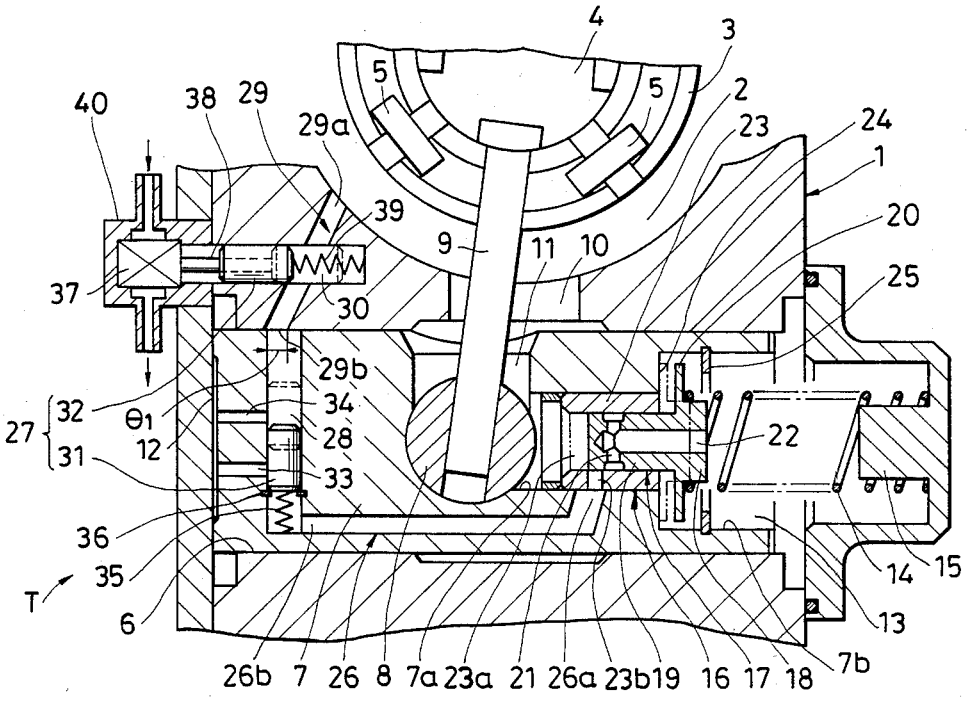
FIG. 1 is a longitudinal sectional view of an injection timing control device in a distributor-type fuel injection pump, according to a first embodiment of the present invention.

Referring first to FIG. 1, there are illustrated an injection timing control device and its peripheral parts in a distributor-type fuel injection pump, according to a first embodiment of the invention. In the figure, reference numeral 1 designates a pump housing within which is defined a suction space 2 filled with pressurized fuel under pressure proportional to the rotational speed of an internal combustion engine associated with the pump. Mounted within the suction space 2 is a roller holder 3 controllable in circumferential position, which has a central axial hole 4 in which is arranged a coupling means connecting between a drive shaft of the pump and a plunger of same, none of which are shown. The roller holder 3 carries a plurality of rollers 5 circumferentially arranged around the central axial hole 4 at equal intervals, and disposed in rolling contact with the cam surface of a cam disc, not shown, secured to an end of the plunger.

An injection timing control device T is provided at the bottom of the pump housing 1, which has a cylinder 6 fixed to the pump housing 1 within which is slidably received a timer piston 7. A rotary coupling 8 is mounted in the timer piston 7 at a central portion thereof for rotation about an axis perpendicular to the axis of the timer piston 7. Secured to the coupling 8 is one end of a connecting rod 9 which extends through a hole 10 formed in the pump housing 1 and a cavity 11 formed in the timer piston and is coupled at the other end to the roller holder 3.

Defined between an end face of the timer piston 7 and an opposed end face of the cylinder 6 is a hydraulic oil chamber 12 which is supplied with pressurized fuel under pressure proportional to the rotational speed of the engine, from the suction space 2. On the other hand, a spring chamber 13 accommodating a timer spring 14 is defined between the other end face of the timer piston 7 and an opposed other end face of the cylinder 6 and communicates with a fuel tank, not shown. The timer spring 14 urges the timer piston 7 against the fuel pressure within the hydraulic oil chamber 12 in a direction of retarting the injection timing or in the leftward direction as viewed in FIG. 1, and has one end fitted on a projection 15 from the other end face of the cylinder 6 and the other end fitted on an enlarged end 18 of a valve body 17 of a servo valve 16.

The servo valve 16 acts to prevent vibration of the timer piston 7 due to a torque reaction force of the roller holder 3, and particularly movement of the timer piston 7 in the injection timing retarting direction. The valve body 17 of the servo valve 16 has a main portion 19 of a circular cross section and having a predetermined axial size, with an integral annular flange 20 adjacent the enlarged end 18. The main portion 19 is formed therein with a first port 21 transversely extending through the other end thereof, and a second port 22 axially extending in the main portion 19 with one end intersecting with a central portion of the first port 21 and the other end opening in an end face of the main portion 19. A portion of the valve body 17 between the other end of the main portion 19 and the annular flange 20 is slidably fitted in a valve body chamber **23*a* defined in a sleeve 23 fitted in an axial hole 7*a* in the timer piston 7, for displacement of the valve body 17 relative to the timer piston 7 in such a manner that when the valve body 17 is moved to an extreme position toward the hydraulic oil chamber 12, the annular flange 20 is brought into urging contact with a stepped shoulder 24 at an end face of an end opening 7*b* in the timer piston 7, whereas when it is moved to the opposite extreme position toward the spring chamber 13, the annular flange 20 is brought into urging contact with a stopper ring 25 fitted in the end opening 7*b* in the timer piston 7 at a location spaced from the stepped shoulder 24** by a predetermined distance.

The valve body chamber **23*a* communicates, on one hand, with the suction space 2 through the cavity 11 and the hole 10, and, on the other hand, with the hydraulic oil chamber 12 through a first communication passage 26 formed within the timer piston 7 and a selector means 27, hereinafter referred to. The first communication passage 26 communicates at one end 26*a* with the valve body chamber 23*a* through a radial hole 23*b* formed in the sleeve 23, and at the other end 26*b* with one end of a first piston chamber 28 of the selector means 27, which extends in the timer piston 7** transversely thereof.

The pump housing 1 is formed therein with a second communication passage 29 with one end **29*b* opening in the inner peripheral surface of the cylinder 6 at a location registrable with the other end of the first piston chamber 28. The suction chamber 2 thus communicates with the hydraulic oil chamber 12 through the second communication passage 29 and the selector means 27 while the timer piston 7 moves through a stroke corresponding to a predetermined starting advance $\theta_1$ in the injection timing determined by the maximum registered area of the second communication passage 29 and the first piston chamber 28. The second communication passage 29 obliquely extends through a second piston chamber 30 of the selector means 27, formed in the pump housing 1, with the other end 29*a* opening into the suction space 2**.

The selector means 27 has first and second pistons 31 and 32 which are slidably received within their respective first and second piston chambers 28, 30. The first piston 31 acts as a selector valve to selectively open and close first and second communication holes 33 and 34 axially extending parallel with each other in the timer piston 7, with their one ends opening into the first piston chamber 28 at longitudinally different locations thereof to communicate the same chamber 28 with the hydraulic oil chamber 12. The first piston 31 is urged by a spring 35 in a direction of closing the second communication hole 34. When the first piston 31 is biased to an extreme position where it closes the first communication hole 33, it urgedly abuts against a stopper ring 36 disposed within the first piston chamber 28, as illustrated by the solid lines in FIG. 1.

The second piston 32 acts as a stop valve to open and close the second communication passage 29, and is coupled to a thermosensitive member 37 formed of a wax pellet or a like material, and urged by a spring 39 in a direction of opening the second communication passage 29. The thermosensitive member 37 is accommodated within a box 40 fixed to the pump housing 1, through which flows engine cooling water, and variable in volume in response to a change in the temperature of the engine cooling water such that when the cooling water temperature is lower than a predetermined value, the thermosensitive member 37 is contracted to keep the second piston 32 in a position where it opens the second communication passage 29, in cooperation with the spring 39, whereas when the cooling water temperature is above the predetermined value, it is swelled to move the second piston 32 against the force of the spring 39 into a position where it closes the second communication passage 29.

The operation of the injection timing control device according to the invention will now be described.

First, before the start of the engine in a cold condition when the cooling water temperature is below the predetermined value, the second piston 32 is biased in a position to open the second communication passage 29, by the force of the spring 39, as indicated by the solid lines in FIG. 1. On this occasion, the fuel pressure within the suction space 2 is low, and accordingly the fuel pressure within the chambers 11, 12 is also low so that the valve body 17 of the servo valve 16 is biased leftward as indicated by the two-dot chain lines in FIG. 1, with its annular flange 20 in urging contact with the stepped shoulder 24 of the timer piston 7 by the force of the timer spring 14 to bias the timer piston 7 in a leftward extreme position as shown in the figure. In this position, the first communication passage 26 communicates with the timer spring chamber 13 through the first and second ports 21, 22 of the valve body 17. The first timer piston 31 is then biased by the force of the spring 35 in a position to close the second communication hole 34 as indicated by the dotted lines in FIG. 1.

When the engine is started with the injection timing control device T in this position, increased fuel pressure within the suction space 2 is transmitted into the first piston chamber 28 through the second communication passage 29 to urgingly bias the first piston 31 downward against the force of the spring 35 to open the second communication hole 34 and simultaneously close the first communication hole 33, as illustrated by the solid lines in the figure.

On the other hand, the increased fuel pressure within the suction space 2 is also transmitted into the valve body chamber **23*a* through the hole 10 and cavity 11 to urgingly bias the valve body 17 rightward against the force of the timer spring 14 into a position indicated by the solid lines in the figure, wherein the first communication passage 26 is disconnected from the timer spring chamber 13 and simultaneously the annular flange 20 of the timer piston 17 is separated from the stepped shoulder 24 of the timer piston 17**.

Figure 2:
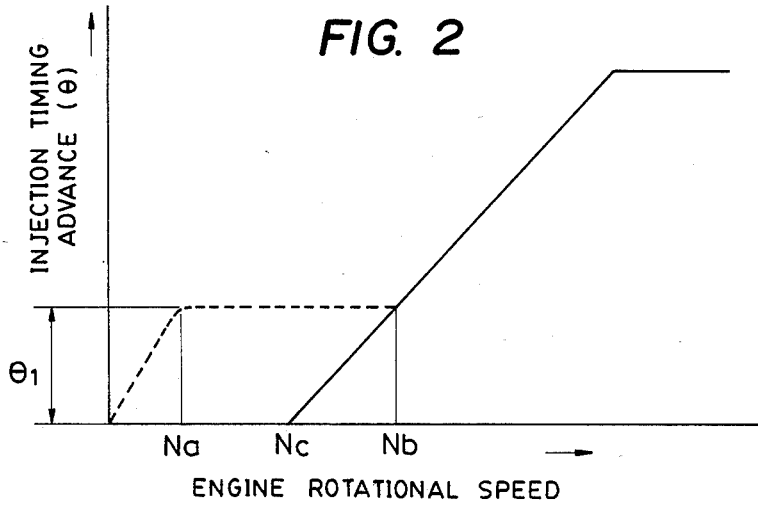
FIG. 2 is a graph showing an injection timing advance characteristic of the injection timing control device of FIG. 1.

The increased fuel pressure introduced into the first piston chamber 28 is guided through the second communication hole 34 into the hydraulic oil chamber 12 so that the increased pressure within the chamber 12 causes displacement of the timer piston 7 in the injection timing advancing direction or in the rightward direction as viewed in FIG. 1. When the engine rotational speed reaches a predetermined value Na in FIG. 2, the correspondingly increased pressure within the hydraulic oil chamber 12 moves the timer piston 7 in the injection timing advancing direction by a predetermined starting stroke $\theta_1$ whereby the end **29*b* of the second communication passage 29 is blocked by the timer piston 7 to provide a confined space defined by the first piston chamber 28, the first communication hole 34 and the hydraulic oil chamber 12. At the same time, the stepped shoulder 24 of the timer piston 7 is brought into urging contact with the annular flange 20 of the valve body 17, whereby the force of the timer spring 14 acts upon the timer piston 7 through the flange 20 to keep the piston 7 in a fixed position to maintain the predetermined starting advance $\theta_1$ in the injection timing until the engine rotational speed reaches a higher predetermined value Nb, as indicated by the horizontal dotted line portion in FIG. 2** which represents a starting advance in the injection timing required for starting the engine in a cold condition.

When the engine rotational speed reaches the predetermined value Nb, the correspondingly increased fuel pressure within the suction space 2 causes rightward displacement of the valve body 17 as viewed in FIG. 1, against the force of the timer spring 14 until the end **26*a* of the first communication passage 26 registers with the radial port 23*b* to communicate with the valve body chamber 23*a*, whereby the fuel pressure within the suction space 2 is introduced into the first piston chamber 28 at the side of the spring 35 through the hole 10 and cavity 11, the valve body chamber 23*a*, and the first communication passage 26 so that the force of the spring 35 and the introduced fuel pressure cooperate to upwardly move the first piston 31 in the chamber 28 to open the first communication hole 33 and simultaneously close the second communication hole 34, as indicated by the dotted lines in FIG. 1. Then, the fuel pressure within the suction space 2 is transmitted through the hole 10 and cavity 11, the valve body chamber 23*a*, the first communication passage 26, the first piston chamber 28, and the first communication hole 33 in the mentioned order into the hydraulic oil chamber 12. The relationship in magnitude between the fuel pressure thus introduced into the chamber 12 and the force of the timer spring 14 determines the axial position of the timer piston 7 within the cylinder 6, which in turn determines the circumferential position of the roller holder 3 by means of the connecting rod 9. A change in the circumferential position of the roller holder 3 causes a corresponding change in the axial operative position of the plunger of the pump relative to the circumferential phase of the drive shaft of the pump to thereby vary the injection timing along an injection timing advance characteristic at normal operation of the engine as indicated by the solid line in FIG. 2. For example, if the engine rotational speed increases, the correspondingly increased fuel pressure within the hydraulic oil chamber 12 surpasses the force of the timer spring 14 to rightwardly displace the timer piston 7 as viewed in FIG. 1 for clockwise displacement of the roller holder 3** to thereby advance the injection timing.

If the temperature of engine cooling water is higher than the aforementioned predetermined value at the start of the engine, the second piston 32 is biased by the thermosensitive member 37 in a rightward position as indicated by the dotted lines in FIG. 1, against the force of the spring 39 whereby the second communication passage 29 is blocked by the second piston 32 to disconnect the first piston chamber 28 from the suction space 2 via the second communication passage 29. In this position, the timer piston 7 remains in its initial or zero advance position until the fuel pressure from the suction space 2 acting upon the valve body 17 through the hole 10 and cavity 11 surpasses the force of the timer spring 14. When the engine rotational speed exceeds a predetermined value Nc, the increased fuel pressure urgingly displaces the valve body 17 rightward against the force of the timer spring 14 so that the combined force of the spring 35 force and the pressure in the first communication passage 26 urgingly moves the piston 31 to open the communication hole 33, and thereafter the timer piston 7 is displaced along the solid line in FIG. 2 to carry out normal injection timing control.

When the fuel pressure from the suction space 2 balances with the timer spring 14 force such as at constant-speed operation or constant-load operation of the engine, the valve body 17 assumes a position wherein the first communication passage 26 is disconnected from both of the suction space 2 and the timer spring chamber 13, i.e. the position illustrated in FIG. 1, the closure of the end 26*a* of the first communication passage 26 by the valve body 17 causes stoppage of flow of the fuel pressure into and out of the hydraulic oil chamber 12 to lock the timer piston 7 in a fixed position, preventing large vibration of the timer piston, particularly movement of same in the injection timing retarding direction or leftward direction as viewed in the figure.

On the other hand, when the engine is stopped, the timer piston 7, the valve body 17, the first piston 31, and the second piston 32 return to their resective initial positions assumed before the start of the engine.

Figure 3:
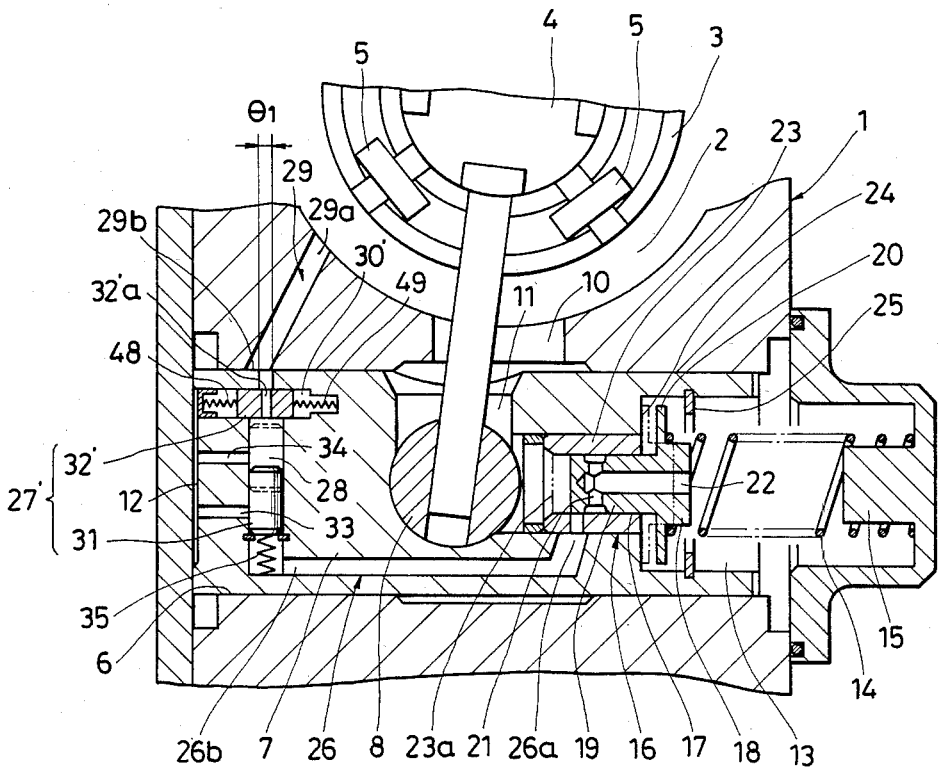
FIG. 3 is a longitudinal sectional view of an injection timing control device according to a second embodiment of the invention.

FIG. 3 shows a second embodiment of the invention. In FIG. 3, parts and elements corresponding to those in FIG. 1 are designated by identical characters, and description of which is omitted. The second embodiment is distinguished from the first embodiment of FIG. 1 only in respect of the second piston of the selector means. To be specific, selector means 27′ includes a second piston chamber 30′ which is formed in the timer piston 7 in a fashion intersecting with an end of the first piston chamber 28 facing the second communication passage 29, and within which is slidably received a second piston 32′ which has its axially intermediate portion formed with a through hole 32′*a* extending transversely thereof, and is urged at one end by a first coiled spring 48 formed of an ordinary elastic metal and at the other end by a second coiled spring 49 formed of a shape memory alloy, both the springs being arranged within the same chamber 30′.

The operation of the second embodiment is as follows: When the fuel temperature sensed by the second coiled spring 49 is below a predetermined value, the force of the first coiled spring 48 surpasses that of the second coiled spring 49 to bias the second piston 32′ in the illustrated position wherein the second communication passage 29 communicates with the first piston chamber 28 through the through hole 32′*a*. When the fuel temperature sensed by the second coiled spring 49 is above the predetermined value, the second coiled spring 49 formed of a shape memory alloy has its force increased to a value exceeding that of the first coiled spring 48 so that the second piston 32′ is biased leftward as viewed in FIG. 3 to disconnect the through hole 32′*a* from the second communication passage 29. Except for this, the injection timing control operation of the second embodiment is substantially identical with that of the first embodiment.

Figure 4:
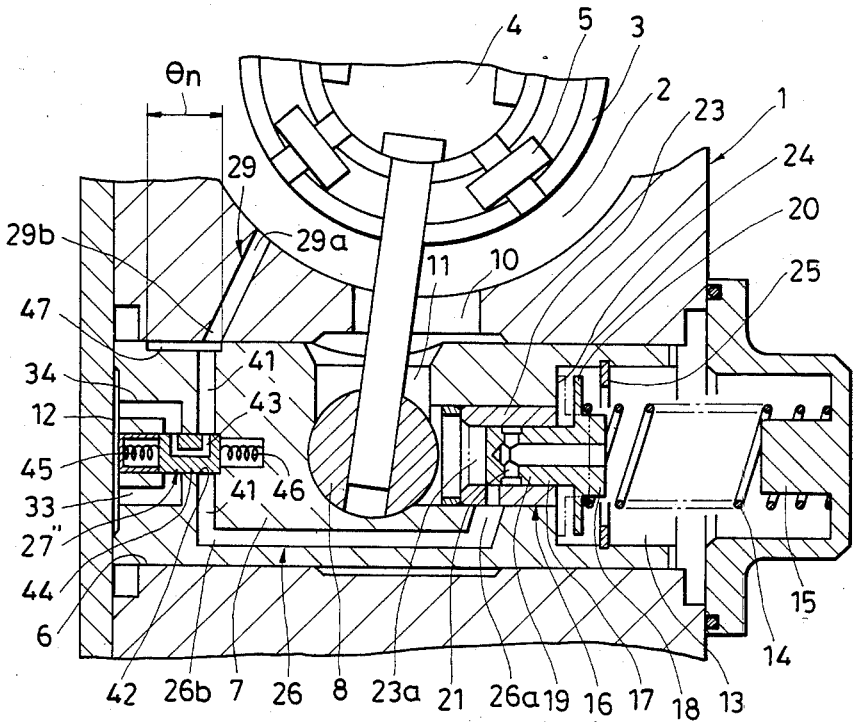
FIG. 4 is a longitudinal sectional view of an injection timing control device according to a third embodiment of the invention.

FIG. 4 shows a third embodiment of the invention. In FIG. 4, parts and elements corresponding to those in FIG. 1 are designated by identical characters, and description of which is omitted. The third embodiment is distinguished from the first embodiment of FIG. 1 in respect of the selector means as a whole. According to selector means 27″ of this embodiment, a passage 41 transversely extends in the timer piston 7 at a substantially identical location with the first piston chamber 28 employed in the first embodiment to supersede the same chamber 28. First and second communication holes 33, 34 each have one end opening into the hydraulic oil chamber 12 and the other end radially extending in the piston 7 and parallel with the passage 41. A rotary valve chamber 42 axially extends in the timer piston 7 across the passage 41, and the first and second communication holes 33, 34. A rotating valve body 44, which has a communication port 43 of a U-shaped cross section formed therein, is received within the rotary valve chamber 42 for rotation about its own axis, and is urged at one end by a torque spring 45 formed of an ordinary elastic metal, and at the other end by a torque spring 46 formed of a shape memory alloy, both the springs being arranged within the chamber 42. The passage 41 has an outer end opening in the outer peripheral surface of the timer piston 7 at a location registrable with the opposed end 29*b* of the second communication passage 29 through an axially elongate groove 47 formed in the outer peripheral surface of the timer piston 7 and having a length corresponding to the maximum injection timing advance stroke $\theta n$.

With the above arrangement, when the atmospheric temperature sensed by the second torque spring 46 is lower than a predetermined value, the force of the second torque spring 45 surpasses the force of the second torque spring 46 to angularly bias the rotating valve body 41 about its own axis in one direction, i.e. in the illustrated position. In this position, a half portion of the passage 41 communicating with the second communication passage 29 via the groove 47 is communicated with the second communication hole 34 through the communication port 43 in the rotating valve body 44. When the atmospheric temperature sensed by the second coiled torque spring 46 increases above the predetermined value, the second torque spring 46 has its force increased to a value surpassing the force of the first torque spring 45 to cause rotation of the rotating valve body 41 in the opposite direction so that the other half portion of the communication passage 41 communicating with the first communication passage 26 is communicated with the first communication hole 33 through the communication port 43.

Figure 5:
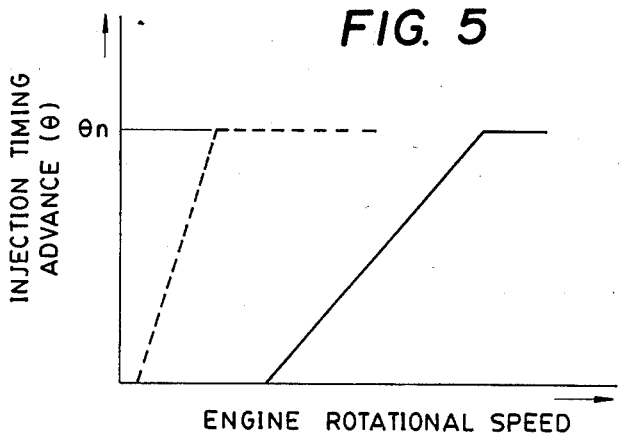
FIG. 5 is a graph showing an injection timing advance characteristic of the injection timing control device of FIG. 4.

The presence of the groove 47 having a length corresponding to the maximum advance stroke $\theta n$ between the passage 41 and the second communication passage 29 brings about a starting injection timing advance characteristic as shown by the dotted line in FIG. 5, at the start of the engine in a cold condition, while a normal starting injection timing advance characteristic indicated by the solid line in FIG. 5 is available with the FIG. 4 arrangement when the engine is not in a cold condition upon starting. Also this embodiment performs a substantially identical injection timing control operation with that of the first embodiment, except for the above stated function.

While preferred embodiments of the invention have been described, obviously modifications and variations are possible without departing from the scope and spirit of the present inventive concept, which are delineated by the appended claims.

What is claimed is:

1. An injection timing control device for combination with a fuel injection pump for an internal combustion engine, said pump being of the type having a suction space filled with fuel under pressure variable as a function of the rotational speed of said engine, a pumping and distributing plunger, and a roller holder carrying a plurality of rollers circumferentially arranged and disposed in camming engagement with said plunger, said injection timing control device comprising: a cylinder; a timer piston slidably received within said cylinder, said timer piston being coupled to said roller holder in a manner such that displacement thereof causes a corresponding change in the circumferential position of said roller holder; a first chamber defined at one end of said timer piston; a second chamber defined at another opposite end of said timer piston, said second chamber communicating with a zone under lower pressure; a timer spring accommodated within said second chamber; first and second communication passageways extending between said suction space of said pump and said first chamber, said first and second communication passageways being located at least in part within said timer piston; servo valve means arranged across said first communication passageway at a location within said timer piston, said servo valve means having a valve body displaceable relative to said timer piston against the force of said timer spring in response to a change in fuel pressure within said suction space, to selectively assume a first position where it disconnects a portion of said first communication passageway closer to said first chamber with respect to said valve body from said suction space and simultaneously communicates same with said second chamber, a second position where it communicates said first communication passageway portion with said suction space and simultaneously disconnects same from said second chamber, and a third position where it disconnects said first communication passageway portion from both of said suction space and said second chamber; means for keeping said second communication passageway opened while said timer piston is displaced from an initial starting position thereof at least to a position corresponding to a predetermined advance in the injection timing, at the start of said engine; selector means responsive to a temperature of said engine to close said first communication passageway portion and simultaneously open said second communication passageway when the temperature of said engine is lower than a predetermined value, and to open said first communication passageway portion and simultaneously close said second communication passageway when the temperature of said engine is higher than said predetermined value.

2. An injection timing control device as claimed in claim 1, wherein said selector means comprises a selector valve responsive to a difference between pressure within said first communication passageway portion and pressure within said second communication passageway to selectively communicate said first chamber with said first communication passageway portion or said second communication passageway, and a stop valve responsive to the temperature of said engine to open or close a portion of said second communication passageway closer to said suction space with respect to said selector valve.

3. An injection timing control device as claimed in claim 2, wherein said selector valve of said selector means comprises a piston chamber formed in said timer piston extending transversely thereof and having one end communicating with said first communication passageway portion and another end communicating with said second communication passageway portion, first and second communication holes axially extending in said timer piston between said piston chamber and said first chamber, said first and second communication holes opening at one ends thereof into said piston chamber at different longitudinal locations, and a piston slidably received within said piston chamber and displaceable in response to a difference between pressure within said first communication passageway portion and pressure within said second communication passageway portion to selectively open and close said first and second communication holes.

4. An injection timing control device as claimed in claim 2, wherein said stop valve of said selector means comprises a second piston chamber extending across said second communication passageway portion, a thermosensitive member arranged in said second piston chamber at one end thereof, and a second piston slidably received within said second piston chamber and couled to said thermosensitive member, said second piston being displaced in response to displacement of said thermosensitive member to close said second communication passageway portion when the temperature of said engine is lower than said predetermined value, and to open said second communication passageway portion when the temperature of said engine is higher than said predetermined value.

5. An injection timing control device as claimed in claim 2, wherein said stop valve of said selector means comprises a second piston chamber extending across said second communication passageway portion, a second piston slidably received within said second piston chamber, a first coiled spring formed of an ordinary elastic material, said first coiled spring being arranged at one end of said second piston and urging same, and a second coiled spring formed of a shape memory alloy, said second coiled spring being arranged at another opposite end of said second piston and urging same, said second piston being displaceable by said first and second coiled springs in a manner such that when the temperature of said engine is lower than said predetermined value, the force of said first coiled spring biases said second piston in a position where said second communication passageway portion is opened, against the force of said second coiled spring, while when the temperature of said engine is higher than said predetermined value, the force of said second coiled spring biases said second piston in a position where said second communication passageway portion is closed, against the force of said first coiled spring.

6. An injection timing control device as claimed in claim 1, wherein said selector means comprises a valve displaceable in response to a change in the temperature of said engine, said valve being formed of a single valve body responsive to the temperature of said engine to close said first communication passageway portion and simultaneously open said second communication passageway to thereby communicate said first chamber with said suction space when the temperature of said engine is lower than said predetermined value, and to open said first communication passageway portion and simultaneously close said second communication passageway to thereby disconnect said first chamber from said suction space when the temperature of said engine is higher than said predetermined value.

7. An injection timing control device as claimed in claim 6, wherein said valve of said selector means comprises a passage formed in said timer piston and having one end communicating with said first communication passageway portion and another end communicating with said second communication passageway, a valve chamber formed in said timer piston across said passage, first and second communication holes extending between said valve chamber and said passage, said single valve body received within said valve chamber for rotation about an axis thereof, and a first torque spring formed of an ordinary elastic material and arranged at one end of said single valve body for rotating same, a second torque spring formed of a shape memory alloy and arranged at another end of said single valve body for rotating same, and communication port means formed in said single valve body, said communication port means being responsive to rotational displacement of said single valve body to communicate said passage with one of said first communication passageway and said second communication passageway while simultaneously disconnecting said passage from the other of said first communication passageway portion and said second communication passageway.

* * * * *